United States Patent [19]

Sakamaki et al.

[11] Patent Number: 4,917,584

[45] Date of Patent: Apr. 17, 1990

[54] VANE PUMP WITH ANNULAR AETAINER LIMITING OUTWARD RADIAL VANE MOVEMENT

[75] Inventors: Hiroshi Sakamaki; Yukio Horikoshi; Takeshi Jinnouchi, all of Sakado, Japan

[73] Assignee: Eagle Industry Co., Ltd., Tokyo, Japan

[21] Appl. No.: 289,445

[22] Filed: Dec. 20, 1988

Related U.S. Application Data

[63] Continuation of Ser. No. 118,142, Nov. 6, 1987, abandoned.

[30] Foreign Application Priority Data

Dec. 3, 1986 [JP] Japan ..... 61-185570[U]

[51] Int. Cl.[4] ..... F04C 2/344

[52] U.S. Cl. ..... 418/256

[58] Field of Search ..... 418/260–265, 418/253, 256

[56] References Cited

U.S. PATENT DOCUMENTS

| | | | |
|---|---|---|---|
| 1,492,456 | 4/1924 | Hansen-Ellehammer | 418/260 |
| 2,562,698 | 7/1951 | Clerc | 418/264 X |
| 2,672,282 | 3/1954 | Novas | 418/265 |
| 3,640,648 | 2/1972 | Odawara | 418/261 |
| 3,988,083 | 10/1976 | Shimizu et al. | 418/264 |
| 4,133,618 | 1/1979 | Smolinski | 418/263 X |
| 4,410,305 | 10/1983 | Shank et al. | 418/264 X |

FOREIGN PATENT DOCUMENTS

| | | | |
|---|---|---|---|
| 505645 | 5/1920 | France | 418/256 |

*Primary Examiner*—John J. Vrablik

*Attorney, Agent, or Firm*—Jordan and Hamburg

[57] ABSTRACT

A vane pump in which between an end surface of a rotor and an inner surface of an end wall of a housing having the rotor supported in an eccentric state is interposed a retainer coaxial with the housing or a bearing, and the retainer or bearing is engaged with vanes to define the pratrusion of the vaned to a given amount, and an inner peripheral surface of the housing is formed correspondingly to the end edges of the vanes which rotates while being subjected to said defining to make a clearance therebetween constant.

6 Claims, 3 Drawing Sheets

VANE PUMP WITH ANNULAR AETAINER LIMITING OUTWARD RADIAL VANE MOVEMENT

This application is a continuation of application Ser. No. 118,142, filed Nov. 6, 1987, now abandoned.

BACKGROUND OF THE INVENTION the present invention relates to a vane pump which is one of pumps used for discharges, compressors, etc.

A vane pump schematically shown in FIG. 6 which has been heretofore widely known.

In FIG. 6, reference numeral 31 designates a house; 32 a rotor inserted eccentrically into a inner peripheral space of the housing 31 and rotatably supported by a rotational shaft 33; 35*a*, 35*b* and 35*c*, plate-like vanes disposed radially retractably from vane grooves 34*a*, 34*b* and 34*c* equally spaced apart so as to peripherally divide the outer peripheral side of the rotor 32 into three sections. When the rotor 32 is rotated in the direction as indicated by the arrow X by the rotational shaft 33, the vanes 35*a*, 35*b* and 35*c* are moved out in the direction of the outside diameter by the centrifugal force, and the end edges thereof rotate while slidably contacting the inner peripheral surface of the housing 31. Since the rotor 32 is eccentric with respect to the housing 31 as previously mentioned, as such rotation occurs, volumes of working spaces 36*a*, 36*b* and 36*c* defined by the housing 31, the rotor 3Z and the vanes 35*a*, 35*b* and 35*c* are repeatedly enlarged and contracted to allow a fluid taken in from the intake port 37 to be discharged out of an outlet port 38.

However, the above-described conventional vane pump has problems that since the vanes slidably move along the inner peripheral surface of the housing at high speeds, the lowering of the rotational efficiency due to the sliding resistance between the end edges of the vanes and the Inner peripheral surfaces of the housing cannot be avoided; the lowering of the volume efficiency of carrier fluid due to the sliding heat cannot be avoided; the vanes are expanded to produce galling with the both inner surfaces in the radial direction of the housing; and considerable wears occur.

In view of these problems, the present invention has been achieved in an attempt of preventing occurrence of resistance or generation of heat due to the sliding movement to enhance the efficiency in said rotation and volume.

SUMMARY OF THE INVENTION

For achieving the aforesaid object, the present invention provides a vane pump comprising a rotor rotatably supported in eccentric fashion in an inner peripheral space of a housing, and plate-like vanes disposed capable of being projected and retracted into a plurality of vane grooves in the form of a dePression in said rotor, wherein repeated variations in volumes of working spaces between the vanes resulting from rotations of the rotor and the vanes are utilized to suck a fluid from one side and discharge it toward the other, characterized in that retainers or the bearings coaxial with the inner peripheral space are fitted internally of the end wall of the housing, the retainers or bearings are engaged with the vanes to define the protrusion the vanes from the vane grooves, and the inner peripheral surface of the housing is formed correspondingly to the locus of the ends of the vanes always in non-contact with the inner peripheral surface of the housing by means of the defining, thereby a uniform clearance is established over the entire circumference between the ends of the vanes and the inner peripheral surface of the housing.

According to the present invention, the appearance of the vanes from the vane grooves is not defined by the contact thereof with the inner peripheral surface of the housing, but is defined so that the end edges of the vanes depict a fixed locus by the engagement of the retainers fitted in the housing and the vanes. Therefore the vanes may be rotated in the state where they are not in contact with the inner surface of the housing. In addition, a uniform clearance is established over the entire circumference between the inner peripheral surface of the housing and the locus of the ends of the vanes always in non-contact with the inner peripheral surface of the housing by means of the defining, and said clearance is made as narrow as possible so as to restrain a leakage of carrier fluids.

Thus, the vane pump according to the present invention is designed so that the vanes ma be rotated in a state not in contact with the inner peripheral surface of the housing, and therefore, the lowering of the rotational efficiency and the wear of vanes resulting from the sliding resistance may be prevented, and the occurrence of the lowering of the volumetric efficiency due to the increase of heat generation caused by sliding may be prevented; and in addition, the inner peripheral surface of the housing is formed correspondingly to the locus of the ends of the vanes always in non-contact with the inner peripheral surface of the housing because of the defining to establish a uniform clearance over the entire circumference between the ends of the vanes and the inner peripheral surface of the housing, and therefore, there can be provided a vane pump of high performance which has a feature that the pump may be always operated effectively with less leakage including the case where the operating conditions of the pump are low speed and high pressure.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show one embodiment for the understanding of the present invention and are not intended to limit the scope of this invention.

DESCRIPTION OF THE PREFERRED EMBODIMENTS

Embodiments of a vane pump according to the present invention will be described with reference to the drawings.

Figure 1:
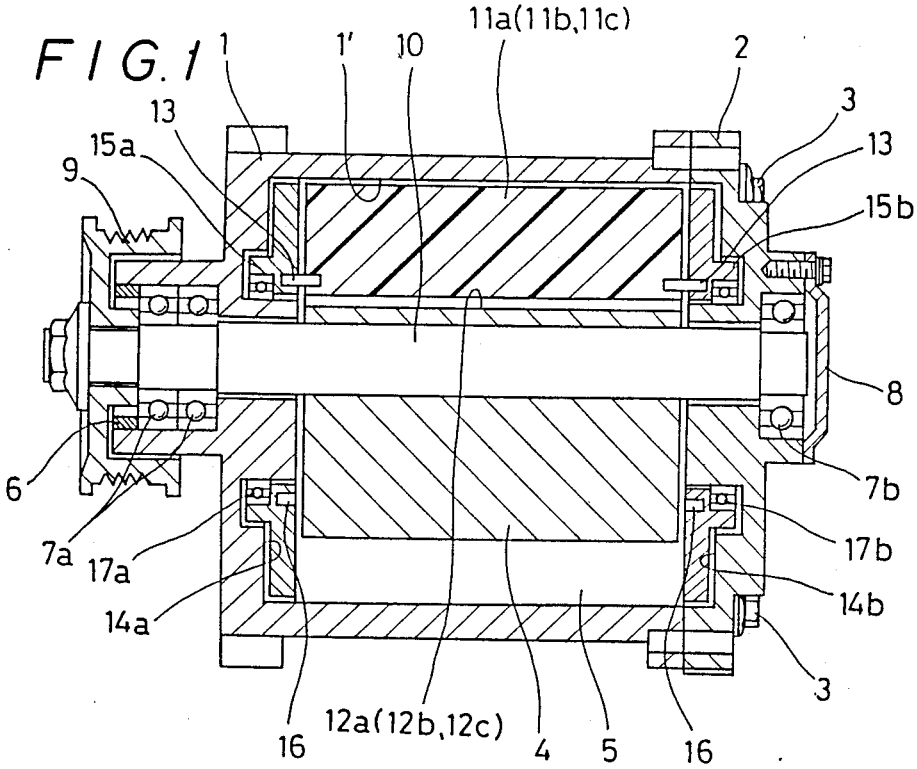
FIG. 1 is a sectional view of a vane pump according to a first embodiment of the present invention.
Figure 2:
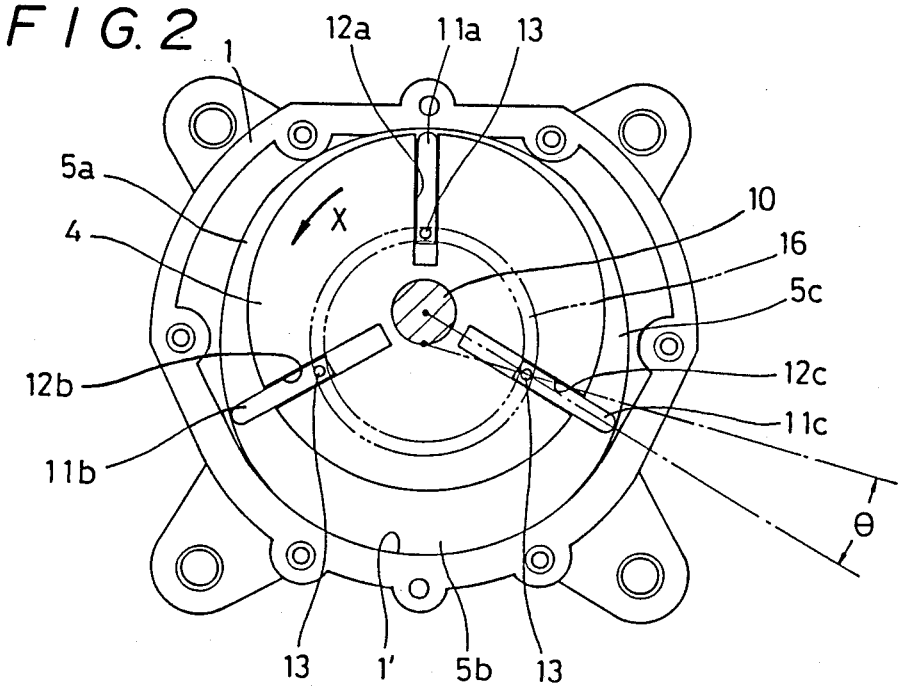
FIG. 2 is an explanatory view of the operation thereof.

In FIGS. 1 and 2 showing a first embodiment, a front housing 1 and a rear housing 2, which both housings are made of non-ferrous metal such as aluminum which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7a held by a fixed ring 6 in anti-slipout fashion in an axial shoulder of the front housing 1 through and a ball bearing 7b held by a bearing cover B in anti-slipout fashion in an axial shoulder of the rear housing 2, and is rotatably mounted on a rotational shaft 10 to which a drive force is transmitted from a pulley 9. Plate-like vanes 11a, 11b and 11c principally made of a carbon material having an excellent slidability are disposed to be radially projected and retracted in vane grooves 12a, 12b and 12c, respectively, which are formed in the form of a depression in an equally spaced apart so as to peripherally divide the outer peripheral side of the rotor 4 into three sections, on the rotor 4. On opposite ends of each of the vanes 11a, 11b and 11c corresponding to axial opposite sides of the rotor 4 are projected steel pins 13 and 13, respectively, and a sleeve bearing (not shown) made of resin having excellent slidability and abrasion resistance is, as occasion demands, slipped over each of said pins 13. Rotatably fitted through ball bearing 17a and 17b in annular recesses 14a and 14b formed in inner surfaces of end walls where the front housing 1 and the rear housing 2 are opposed to each other in coaxial with the inner peripheral space 5 of the housing (in coaxial with an inner peripheral surface 1' of the front housing 1) are retainer plates 15a and 15b made of non-ferrous metal such as aluminum each having an annular race 16. The pins 13 and 13 projected on the respective vanes 11a, 11b and 11c peripherally slidably engage the annular races 16 and 16 of the retainer plates 15a and 15b. This engagement defines the radial movement of the vanes 11a, 11b and 11c during rotation so as to maintain a state in which there is formed a slight clearance between the end edges thereof and the inner peripheral surface 1' of the front housing 1.

The operation of the above-described vane pump will be described hereinafter. When the rotational shaft 10 and rotor 4 are rotated bY the drive force from the pulley 9, the vanes 11a, 11b and 11c also rotate, and the pins 13 and 13 projected on the vanes 11a, 11b and 11c, respectively, rotate along the annular races 16 and 16. As shown in FIG. Z, the inner peripheral surface 1' of the housing and the annular race 16 are in the coaxial relation, and the annular race 16 and the rotor 4 are in the eccentric relation, and therefore, as the rotation takes place, the vanes 11a, 11b and 11c are radially slidably moved in the vane grooves 12a, 12b and 12c of the rotor 4 and repeatedly projected and retracted to repeatedly increase or decrease the volume of the working spaces 5a, 5b and 5c defined by the housings 1, 2, the rotor 4 and the vanes 11a, 11b and 11c. That is, FIG. 2 shows the process in which the working space 5a increases its volume upon rotation to suck a fluid from an intake port (not shown) opening to said portion; the working space 5c decreases its volume upon rotation to discharge a fluid toward an outlet part (not shown) opening to said portion; and the working space 5b transfers the sucked fluid toward the outlet part. In the aforesaid operation, since the end edges of the vanes 11a, 11b and 11c are not in sliding contact with the inner peripheral surface 1' of the front housing as previously mentioned, no wear and high heat occur. The pins 13 are slidably rotated within the annular race 16 of the retainer plates 15a and 15b by the centrifugal force while being urged against the outside diameter side but the retainer plates 15a and 15b are in the smoothly rotating state by the provision of the dynamical pressure bearing mechanism and therefore rotate following the pins 13. The relative sliding speed between the pins 13 and the annular races 16 is very small, thereby the wear of the annular races 16 (retainer plates 15a and 15b), the pins 13 and the like can be minimized.

In the above-described operation, the locus depicted by the ends of the vanes 11a, 11b and 11c will be discussed in detail. It is considered that the locus is not circular as viewed in the same direction as that shown in FIG. Z. That is, as described above, the vanes 11a, 11b and 11c are radially projected and retracted from the rotor 4 but the appearance of the vanes 11a, 11b and 11c is defined by the annular race 16 eccentric with respect to the rotor 4 while being crossed except the top position and the bottom position where a meridian of the rotor 4 and that of the annular race 16 are superposed to each other. Assuming a circle (not shown, coaxial with the annular race 16) whose diameter is a line connecting the ends of the vanes at the top position where the vanes 11a, 11b and 11c are most moved into the vane grooves 12a, 12b and 12c and the bottom position where the vanes 11a, 11b and 11c are most moved out of the vane grooves 12a, 12b and 12c, the locus actually depicted by the ends of the vanes by an inclination ( $\theta$) of the vanes 11a, 11b and 11c on the basis of the crossing of the meridians does not form a circle but forms a longitudinal approximate ellipse except the top position and the bottom position. On the other hand, the inner peripheral surface 1' of the housing has to be made larger than the circle even in the top position and the bottom position so as not to contact the ends of the vanes. If the inner peripheral surface 1' of the housing is formed to have a circle whose diameter comprises the dimension thereof, there produces a relatively large clearance which is peripherally uneven relative to the ends of the vanes which rotate in the form of the ellipse whereby a large quantity of carrier fluids leak and particularly when the rotation of the pump is low in speed and the pressure is high, there gives rise to a significant trouble. In view of this, in the present invention, in addition to the above-described structure, the shape of the inner Peripheral surface of the housing does not comprise a circle as viewed in the same direction as that of FIG. 2, but comprises an ellipse larger than the locus of the ends of the vanes which presents the first mentioned ellipse, whereby an even and extremely narrow clearance over the entire circumference is established to prevent the aforesaid inconveniences.

Figure 3:
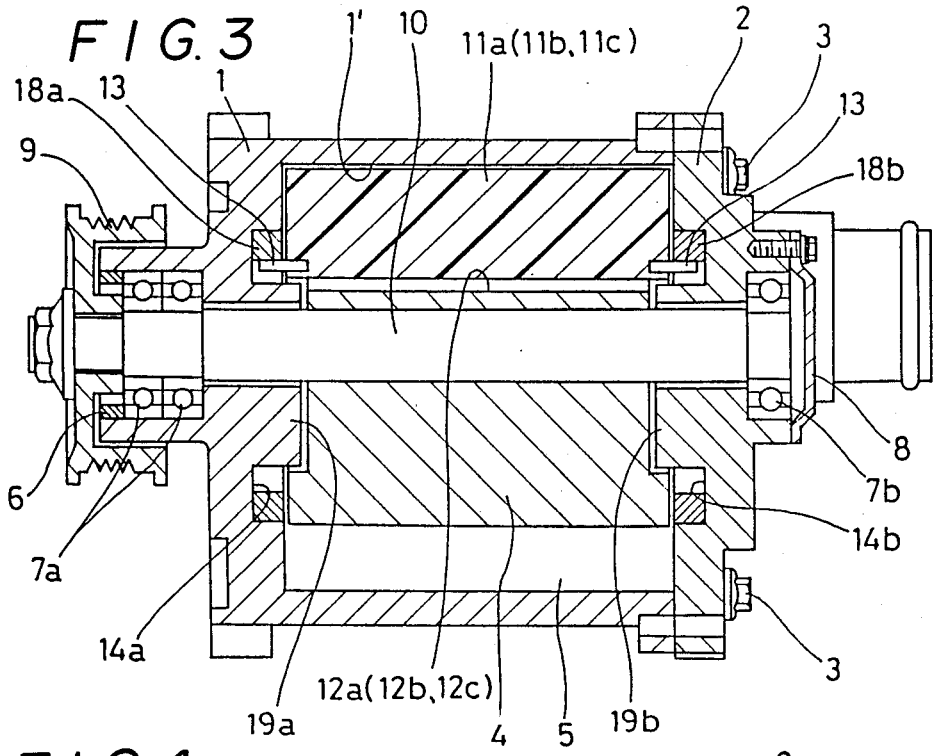
FIG. 3 is a sectional view of a vane pump according to a second embodiment of the present invention.

Next, the second embodiment of the present invention will be described in respect of those different from the first embodiment. As shown in FIG. 3, in this pump, retainer rings 18a and 18b having a simple rectangular section in place of the retainer plates 15a and 15b having the annular races 16 in the first embodiment are fitted in the annular recesses 14a an 14b to reduce the trouble and cost required for manufacturing the retainer rings 20a and 20b. The pins 13 projected on both the ends of the vanes 11a, 11b and 11c engage the inner peripheral surfaces of the retainer rings 18a and 18b and are maintained to be not in contact with the inner peripheral surface 1' of the housing while defining the appearance of the vanes from the vane grooves 12*a*, 12*b* and 12*c*, the inner peripheral surface 1' of the housing being formed into an approximate ellipse similar to the first embodiment. The retainer rings 18*a* and 18*b* are provided in their surfaces in contact with the housings 1 and 2 such as the outer peripheral surfaces or ends thereof with dynamical pressure bearing mechanisms such as a spiral groove, Rayleigh step groove or herringbone groove as needed so as to provide a smooth rotation of the retainers 18*a* and 18*b*. The retainer rings 18*a* and 18*b* can be replaced by ball bearings (not shown). With this structure, the vanes 11*a*, 11*b* and 11*c* are made free in the direction of withdrawal into the vane grooves 12*a*, 12*b* and 12*c*, and when the pump stops or rotates at a low speed, the vanes 11*a*, 11*b* and 11*c* freely withdraw, which movement causes an impact load to receive resulting in an early damage. Therefore, bosses 19*a* and 19*b* as stoppers are projected on the inside diameter side of the vanes 11*a*, 11*b* and 11*c* to define the free movement of the vanes 11*a*, 11*b* and 11*c* . The bosses 19*a* and 19*b* in the form of an annulus are in coaxial with the inner PeriPheral space 5 of the housing 1 and molded integral with the end walls of the front housing 1 and the rear housing 2.

Figure 4:
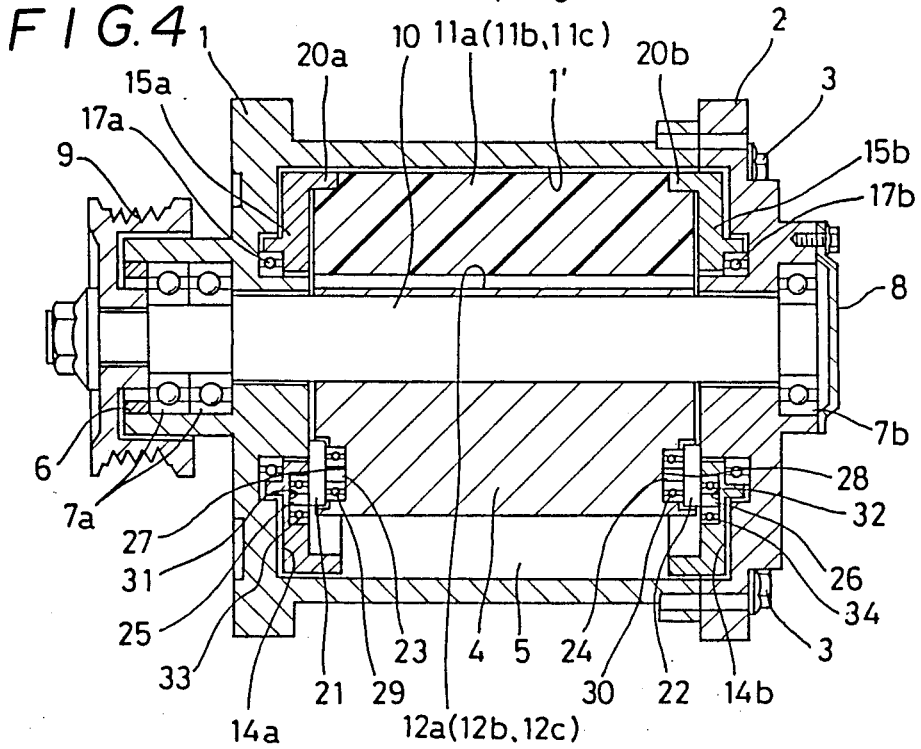
FIG. 4 is a sectional view of a vane pump according to a third embodiment of the present invention.
Figure 5:
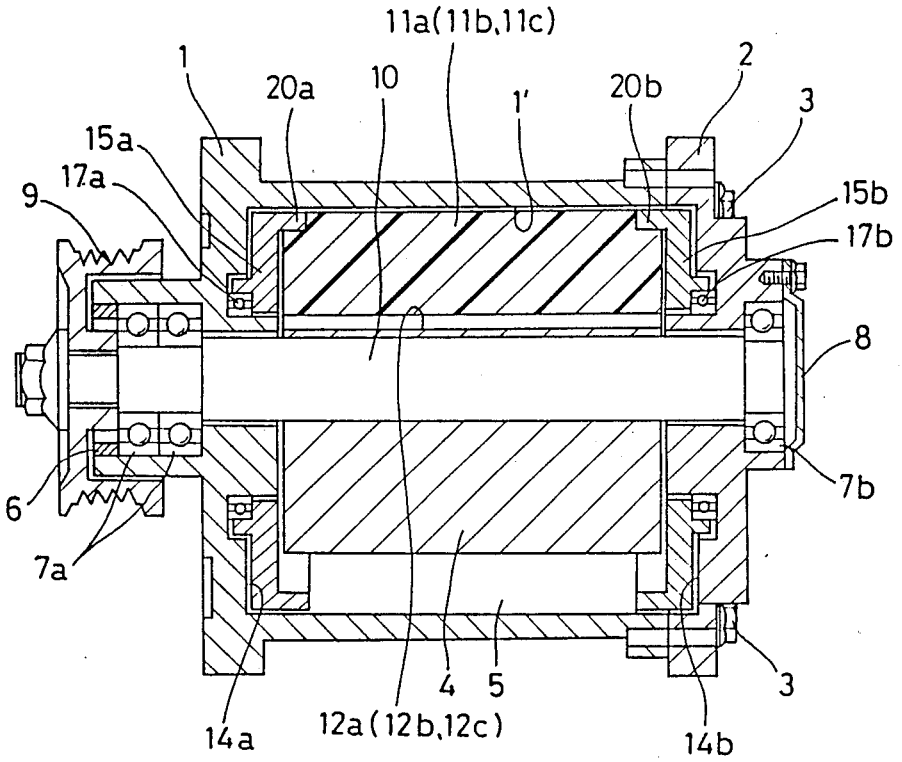
FIG. 5 is a sectional view of a vane pump according to another embodiment of the present invention.
Figure 6:
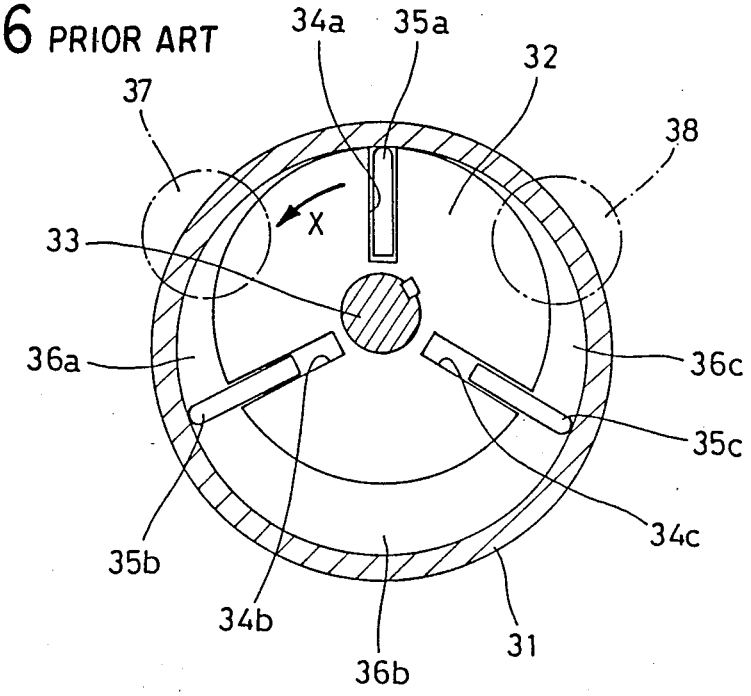
FIG. 6 PRIOR ART
FIG. 6 is an explanatory view showing a schematic structure of a conventional vane pump.

FIG. 4 shows a third embodiment of the present invention, in which stoppers 20*a* and 2O*b* projected in a direction parallel with the axis are formed on the outer peripheral ends of the retainer plates 15*a* and 15*b* to define the protrusion of the vanes 11*a*, 11*b* and 11*c*, and the inner peripheral surface 1' of the housing is molded into an approximate elliptic shape while adjusting to the locus of the ends of the vanes. In the case of this embodiment, however, the engagement between the vanes 11*a*, 11*b* and 11*c* and the stoppers 20*a* and 20*b* is made in the vicinity of the inner peripheral surface 1' of the housing as compared with the case where the pin 13 is engaged with the annular race 16 in the above-described first and second embodiments, and therefore a shape relatively close to a circle would be maintained. In FIG. 4, reference numerals 21 and 22 designate cams for rotatively connecting the rotor 4 and the retainer plates 15*a* and 15*b* between the opposed ends thereof, three of such cams being provided on one surface of the rotor 4 in equally spaced relation. The cams 21 and 22 fitted in recesses 27 and 28 formed in equally spaced relation in the end surface of the rotor 4 have first pins 23 and 24 in engagement with the rotor 4 projected in the center of one surface (inner surface) of a circular rotary disk and rotatably mounted on the rotor 4 through ball bearings 29 and 30. The cams 21 and 22 further have second pins 25 and 26 in engagement with the retainer plates 15*a* and 15*b* projected in the vicinity of the peripheral edge of the other surface (outer surface) of said rotary disk, the second pins 25 and 26 being rotatably engaged with recesses 31 and 3Z formed in the retainer plates 15*a* and 15*b* through ball bearings 33 and 34. The first pins 23, 24 and second pins 25, 26 are on the circumferences of the same diameter made eccentric with each other by the eccentric amount of the rotor 4, and the retainer plates 15*a* and 15*b* are rotated in synchronism with the rotor 4 by the cams 21 and 22. The pump can be simplified in construction by removing the cams 21 and 22 as shown in FIG. 5, and in addition, the bosses mentioned in the second embodiment can be added to provide means for defining the movement of the vanes 11*a*, 11*b* and 11*c* .

While we have described the preferred embodiment of the present invention, it will be obvious that various other modifications can be made without departing the principle of the present invention. Accordingly, it is desired that all the modifications that may substantially obtain the effect of the present invention through the use of the structure substantially identical with or corresponding to the present invention are included in the scope of the present invention by the appended claim.

What is claimed is:

1. A vane pump comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means having longitudinal ends, recess means in said longitudinal ends, retainer plate means disposed between said housing means and said longitudinal ends of said vane means, rotatable support means for rotatably supporting said retainer plate means in said housing means, said retainer plate means having stopper means extending axially into said recess means in said vane means, said stopper means having an annular surface, said annular surface being engaged by said recess means to limit the extent of outward radial movement of said vane means to preclude sliding contact between said vane means and said inner peripheral surface of said rotor chamber, said inner peripheral surface of said rotor chamber having a non-circular configuration corresponding to the configuration of the path of travel of the outer radial ends of said vane means to thereby provide a uniform clearance between said inner peripheral surface of said rotor chamber and said path of travel of said outer radial ends of said vane means.

2. A vane pump comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means having longitudinal ends, recess means in said longitudinal ends, retainer plate means disposed between said housing means and said longitudinal ends of said vane means, bearing means for rotatably supporting said retainer plate means in said housing means, said retainer plate means having stopper means extending axially into said recess means in said vane means, said stopper means having an annular surface, said annular surface being engaged by said recess means to limit the extent of outward radial movement of said vane means to preclude sliding contact between said vane means and said inner peripheral surface of said rotor chamber, said inner peripheral surface of said rotor chamber having a non-circular configuration corresponding to the configuration of the path of travel of the outer radial ends of said vane means to thereby provide a uniform clearance between said inner peripheral surface of said rotor chamber and said path of travel of said outer radial ends of said vane means.

3. A vane pump comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means having longitudinal ends, recess means in said longitudinal ends disposed at the outer radial ends of said vane means, retainer plate means disposed between said housing means and said longitudinal ends of said vane means, said retainer plate means having stopper means extending axially into said recess means in said vane means, said stopper means having an annular surface, said annular surface being engaged by said recess means to limit the extent of outward radial movement of said vane means to preclude sliding contact between said vane means and said inner peripheral surface of said rotor chamber, said inner peripheral surface of said rotor chamber having a non-circular configuration corresponding to the configuration of the path of travel of the outer radial ends of said vane means to thereby provide a uniform clearance between said inner peripheral surface of said rotor chamber and said path of travel of said outer radial ends of said vane means.

4. A vane pump comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means having longitudinal ends and outer radial ends, recess means in said longitudinal ends and extending radially inwardly from said outer radial ends of said vane means, retainer plate means disposed between said housing means and said longitudinal ends of said vane means, said retainer plate means having stopper means extending axially into said recess means in said vane means, said stopper means having an annular surface, said annular surface being engaged by said recess means to limit the extent of outward radial movement of said vane means to preclude sliding contact between said vane means and said inner peripheral surface of said rotor chamber, said inner peripheral surface of said rotor chamber having a non-circular configuration corresponding to the configuration of the path of travel of the outer radial ends of said vane means to thereby provide a uniform clearance between said inner peripheral surface of said rotor chamber and said path of travel of said outer radial ends of said vane means.

5. A vane pump comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said housing means having a rotor chamber end wall perpendicular to said central axis, said rotor means having a plurality of generally radially disposed vane slots, a plurality of vane means slidably mounted in said vane slots and operable to define variable volume chambers for effecting a pumping action as said rotor means rotates and said vane means having alongitudinal ends, recess means in said longitudinal ends, retainer plate means disposed between said end wall of said housing means and said longitudinal ends of said vane means, said end wall having an end wall recess, bearing means in said end wall recess for rotatably supporting said retainer plate means, said retainer plate means having stopper means extending axially into said recess means in said vane means, said stopper means having an annular surface, said annular surface being engaged by said recess means to limit the extent of outward radial movement of said vane means to preclude sliding contact between said vane means and said inner peripheral surface of said rotor chamber, said inner peripheral surface of said rotor chamber having a non-circular configuration corresponding to the configuration of the path of travel of the outer radial ends of said vane means to thereby provide a uniform clearance between said inner peripheral surface of said rotor chamber and said path of travel of said outer radial ends of said vane means.

6. A vane pump according to claim 5, wherein said retainer plate means has an axial projection extending into said end wall recess.

* * * * *